US006152048A

United States Patent [19]

Vander Park

[11] Patent Number: 6,152,048

[45] Date of Patent: Nov. 28, 2000

[54] BEAM-TYPE OFFICE FURNITURE SYSTEM AND MODULES

[75] Inventor: Antonius A. Vander Park, Caledon, Canada

[73] Assignee: Nova-Link Limited

[21] Appl. No.: 09/194,804

[22] PCT Filed: May 30, 1997

[86] PCT No.: PCT/CA97/00369

§ 371 Date: Dec. 3, 1998

§ 102(e) Date: Dec. 3, 1998

[87] PCT Pub. No.: WO97/46140

PCT Pub. Date: Dec. 11, 1997

[30] Foreign Application Priority Data

Jun. 4, 1996 [GB] United Kingdom ..... 9611578
Jun. 4, 1996 [GB] United Kingdom ..... 9611587

[51] Int. Cl.[7] ..... A47B 37/00

[52] U.S. Cl. ..... 108/50.02; 312/223.3; 312/196; 52/36.1

[58] Field of Search ..... 108/50.02, 50.01, 108/102; 312/194, 195, 196, 198, 223.3, 257.1, 265.4, 223.6; 52/36.1, 36.5, 220.7, 239

[56] References Cited

U.S. PATENT DOCUMENTS

| | | | |
|---|---|---|---|
| 756,749 | 4/1904 | Watts . | |
| 2,466,482 | 5/1949 | Russell . | |
| 4,224,769 | 9/1980 | Ball et al. . | |
| 4,420,087 | 12/1983 | Johns | 52/36.5 X |
| 4,600,173 | 7/1986 | Frascaroli . | |
| 4,602,570 | 7/1986 | Lee . | |
| 4,838,177 | 6/1989 | Vander Park . | |
| 4,852,500 | 8/1989 | Ryburg et al. . | |
| 4,932,177 | 6/1990 | Hinden . | |
| 5,038,539 | 8/1991 | Kelley et al. . | |
| 5,058,331 | 10/1991 | Epps | 52/36.1 |
| 5,081,808 | 1/1992 | Bastian et al. . | |
| 5,083,512 | 1/1992 | Newhouse et al. | 108/50.02 |
| 5,103,741 | 4/1992 | Grund et al. | 312/196 X |
| 5,207,041 | 5/1993 | Wills . | |
| 5,325,904 | 7/1994 | Leitner . | |
| 5,499,868 | 3/1996 | Schainholz . | |
| 5,609,402 | 3/1997 | Kemp | 312/265.4 |
| 5,746,488 | 5/1998 | LaCour | 312/196 |
| 5,833,332 | 11/1998 | Marshall et al. | 312/233.3 |
| 5,899,025 | 5/1999 | Casey et al. | 108/50.02 X |

FOREIGN PATENT DOCUMENTS

| | | | |
|---|---|---|---|
| 145410 | 6/1985 | European Pat. Off. | 312/223.3 |
| 0637422 | 2/1995 | European Pat. Off. . | |

*Primary Examiner*—Peter M. Cuomo
*Assistant Examiner*—Hanh V. Tran
*Attorney, Agent, or Firm*—Cummings & Lockwood

[57] ABSTRACT

A work station suitable for mounting electrical, communication and computer equipment has a hollow support beam capable of supporting work surfaces and equipment on one side of the beam. Legs mount the beam in a horizontal position above a floor. Support brackets are detachably connected to a side of the beam and work surface members are mounted on these brackets. A support wall is detachably mounted on top of the beam and this wall has rigid metal side panels with rails for attaching shelving and other devices. Each support bracket has an arm supporting section extending perpendicular to the length of the bracket and an upwardly and forwardly extending front section connected to the forward position. The work surface members are connected to this front section.

19 Claims, 11 Drawing Sheets

BEAM-TYPE OFFICE FURNITURE SYSTEM AND MODULES

This invention relates to work stations suitable for mounting electrical, communication and computer equipment such as computer monitors and telephone turrets. This invention further relates to support brackets that can be used in these work stations.

Work stations suitable for mounting electrical, communication and computer equipment are well known and are available from different manufacturers. One such known work station system is shown and described in the applicant's U.S. Pat. No. 4,838,177 issued Jun. 13, 1989 and entitled "BEAM-TYPE WORK STATION SYSTEM". The corresponding British patent is U.K. patent No. 2,197,189 filed May 5, 1987. These patents describe office furniture in the form of work stations that have a horizontal hollow support beam from which extend detachable support brackets having arm portions extending outwardly and upwardly. A flat work surface member is mounted on an outer section of the arm portions horizontally away from and above the top of the beam. Equipment can be mounted on the beam side of the work surface member so that a lower portion of the equipment is positioned below the horizontal plane defined by the top of the work surface. This known work station system has been very successful due to its ability to carry, and allow relatively easy installation of, a substantial amount of equipment and cabling while maintaining an aesthetically pleasing appearance.

Published European Patent Application No. 0 006 707 describes a space divider system suitable for an office which includes a plurality of posts with at least one beam assembly supported by the posts. The posts and the beam constitute a raceway for receiving electrical wiring and further constitute a rigid structure for supporting various components including acoustic panels that extend upwardly from the beam. Although these acoustic panels are suitable for dividing up the office space and providing privacy, because they are made of a foamed material and covered in a fabric, these panels are generally not suitable for supporting items such as electrical equipment and shelving.

More recent European Published Patent Application No. 0 637 422 which was published in 1995 describes freestanding modular furniture that can be used to create workstations in an open office plan. Each furniture unit includes a work surface and a mounting rail extends continuously along the rearward edge of the work surface. This rail is capable of removably supporting a plurality of different amenities, such as bookshelves, stands and lamps. A removable stanchion permits certain amenities to be supported along the rear of the work surface on the rail.

Improvements and additions to the aforementioned work station system of U.S. Pat. No. 4,838,177 have now been developed in order to accommodate a substantially increased use of electrical equipment such as computers and telephone systems.

A preferred embodiment of applicant's improved work station comprises a beam-type work station module or a series of modules configured into a unitary system. These or each module has a vertically extending core that includes a horizontal support beam and a support wall extending upwardly from the beam. As in the work station of U.S. Pat. No. 4,838,177, a work area is supported in cantilever fashion from one side of the beam of the module and can extend across the face of the module. The work area is provided by horizontal work surface members that are supported by support brackets or arms that extend upwardly and outwardly from the beam of the module. The beam of one module can be connected to the beam of another module to create a series of two or more modules. The preferred support bracket described herein is adjustable with respect to its horizontal length to permit it to be shortened or lengthened. In this way, the horizontal distance of the work surface members from the vertical core can be varied depending on the particular requirements of the work station.

According to one aspect of the invention, a workstation suitable for mounting electrical equipment includes a hollow support beam adapted to support the equipment on at least one side of the beam during use of the workstation, support legs for mounting the beam in a horizontal position above a floor, support brackets detachably connected to at least one side of the beam and supported thereby, and horizontal work surface members mounted on the support brackets. There is also a vertically extending support wall detachably mounted on top of the beam and supported thereby and this wall includes rigid vertical support columns that extend through openings formed in the top of the beam, two rigid metal panels formed by extrusion and forming two opposite sides of the support wall, and means for attaching load bearing members integrally formed on the two metal panels by the extrusion process. Each column has a first side and a second side opposite the first side and the two metals are mounted directly to and on the first and second sides of the support columns. There are also connecting members detachably and fixedly connecting the support columns to the top of the beam. Preferably the columns are held in place to prevent lateral movement in at least two locations vertically spaced apart through the beam. Preferably the aforementioned attaching means on the metal side panel of the wall is in the form of wall flanges or rails that extend the length of the module and that are able to provide support for equipment surfaces or shelves extending over or in the direction of the work area.

The preferred support columns for the wall can be made shorter or taller with their height depending upon the particular requirements of the desired work station configuration. A support wall of sufficient height can support equipment surfaces or shelves for carrying electrical equipment such as monitors and even telephones.

According to another aspect of the invention, an extendible support bracket for supporting a work surface member or similar horizontal supporting member includes an elongate arm section having a rearward portion and a forward portion slidably adjustable with respect to the rearward portion and connected thereto. This arrangement permits the length of the arm section to be varied. There is also an arm supporting section extending generally perpendicular to the length of the arm section and rigidly connected to the rearward portion adjacent an inner end section thereof. An upwardly and forwardly extending front section is rigidly connected to the forward portion and has an elongate top for engaging and supporting the work surface member or supporting member. The front section has means for attaching the work surface member or supporting member thereto.

In a preferred embodiment of the support bracket, the forward portion is mounted in a telescoping manner in the rearward portion and both the rearward and forward portions are substantially channel-shaped, elongate members with upper and lower flanges that extending horizontally during use of the support bracket.

According to still another aspect of the invention, a work station suitable for mounting electrical equipment includes a hollow beam of sufficient strength to support the equipment above and on at least one side of the beam and support legs for mounting the beam in a horizontal position above a floor. There is also a horizontally extending support structure, including support brackets connectible to the beam, for supporting the equipment on the beam on at least one side thereof. An elongate first raceway suitable for wire and cable is mounted a distance above the beam and extends parallel to a top of the beam. There are means for supporting this raceway above the beam. The supporting means are connected to the beam. The beam itself is adapted to provide a second raceway suitable for electrical cable and separated from the first raceway.

In a preferred work station, the first raceway is an open mesh raceway that can extend the entire length of each module above the beam and below the height of work surface members mounted on the beam. All low voltage cables can be fed into and out of the first raceway at the rear of the module.

Further features and advantages of the various aspects of the invention will become apparent from the following detailed description taken in conjunction with the accompanying drawings.

Figure 1:
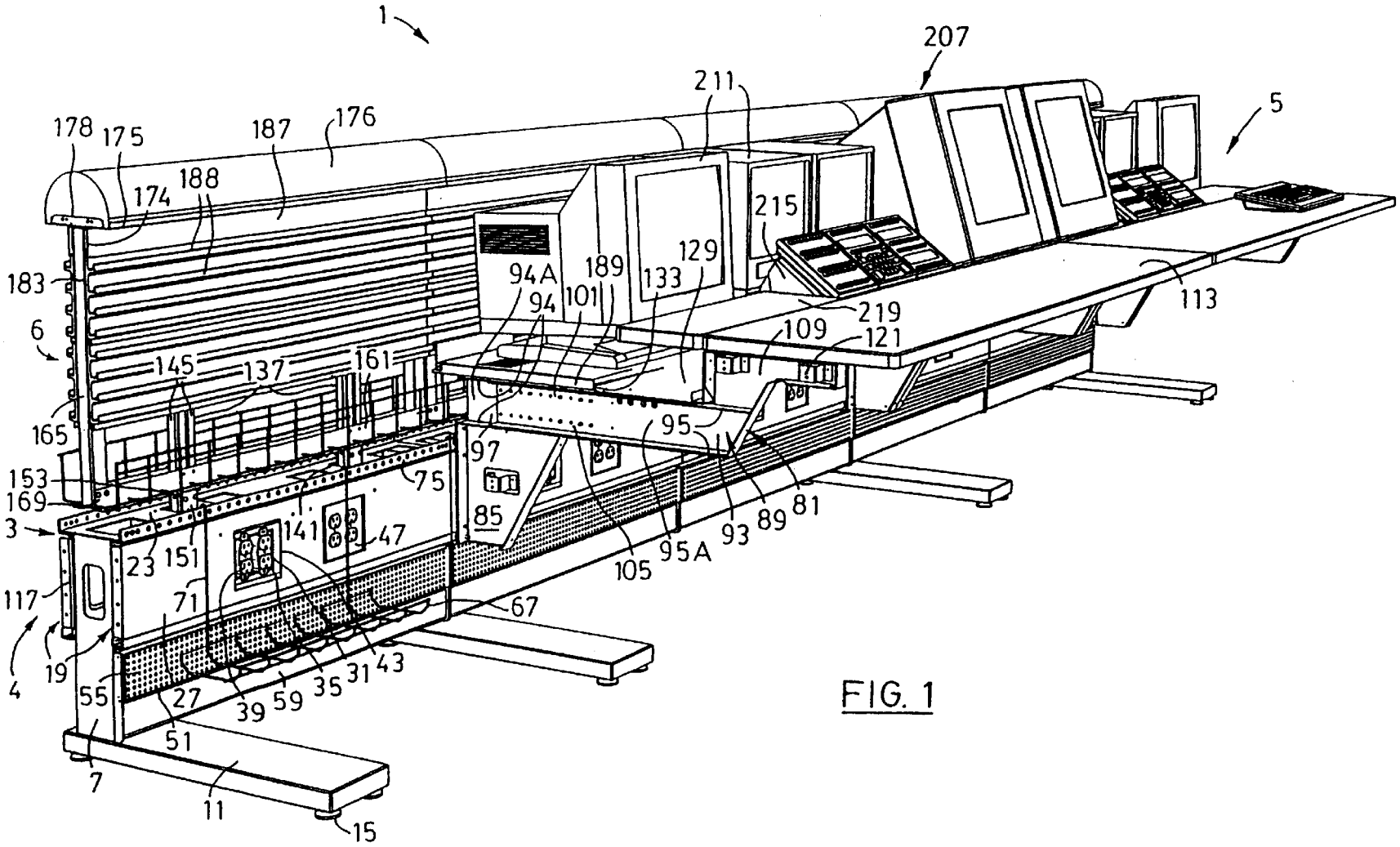
FIG. 1 is a perspective view taken from the front side and from one end of a beam-type office furniture or work station system constructed in accordance with the invention.
Figure 2:
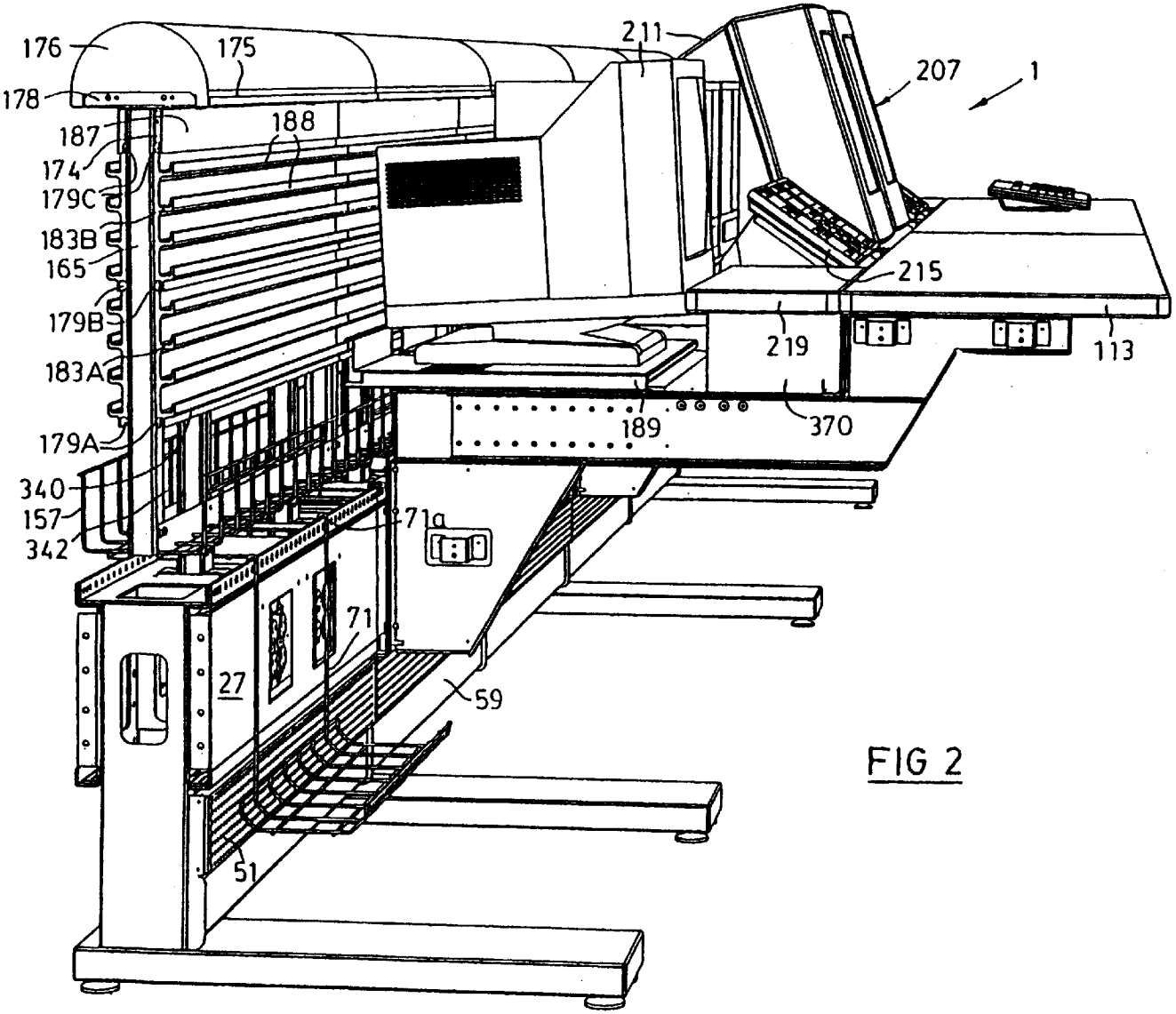
FIG. 2 is another perspective view taken from one end of the system of FIG. 1.
Figure 3:
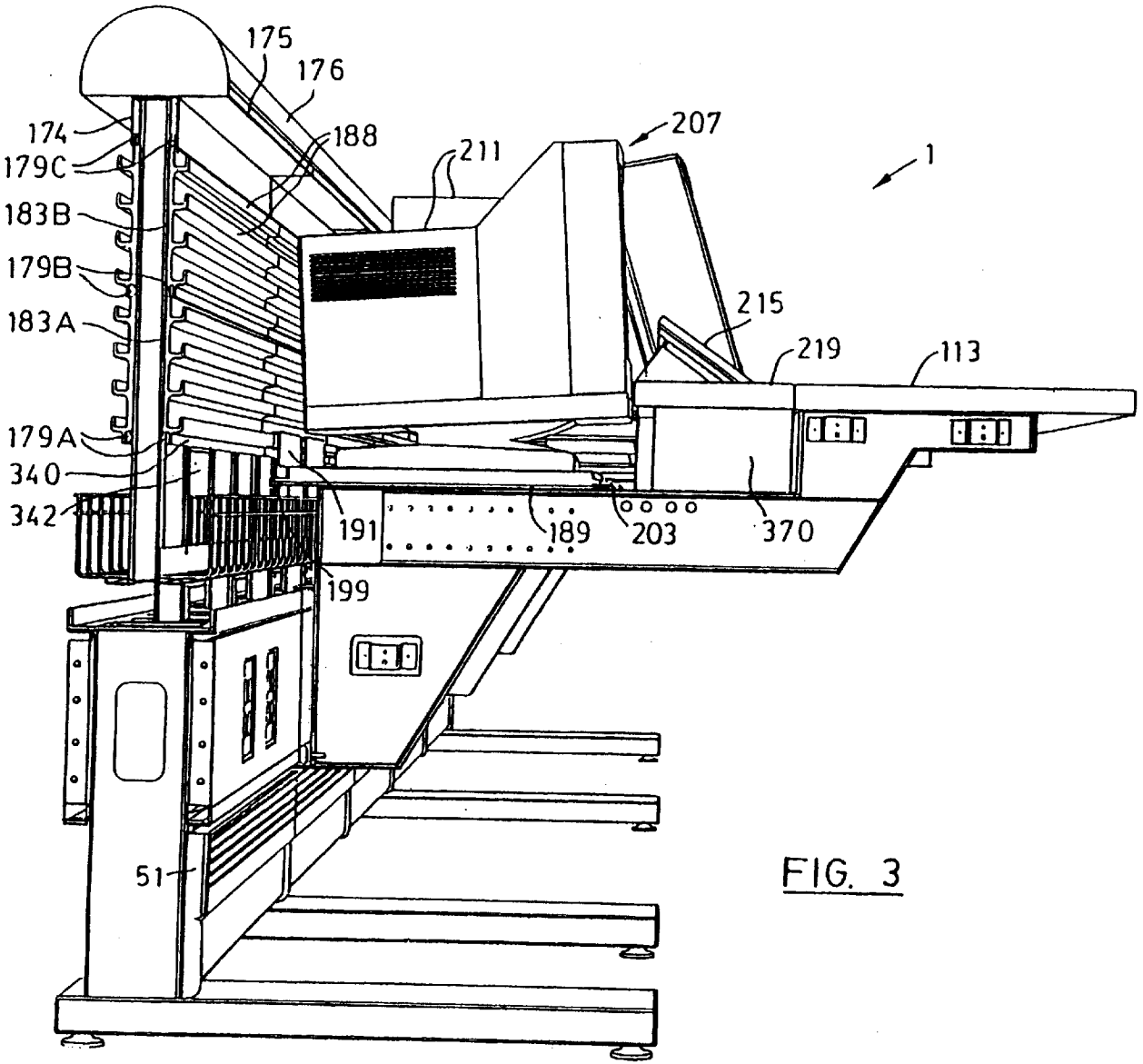
FIG. 3 is a further perspective view taken from one end of a work station constructed in accordance with the invention.

Referring to FIGS. 1 to 3 of the drawings, there is shown therein a beam-type office furniture or work station system 1 employing a relatively large, hollow support beam 3 of sufficient strength to support work surfaces and equipment such as electrical, communication and computer equipment. A number of the aspects of this beam-type work station have already been described in the aforementioned United States patent of the applicant, including the basic construction of the horizontal beam 3 and the support leg 7 for mounting the beam in a horizontal position above a floor. These basic, known features, of a beam-type work station and the construction thereof will not be repeated herein except to the extent required to understand the various aspects of the invention to which the present application is directed.

Figure 8:
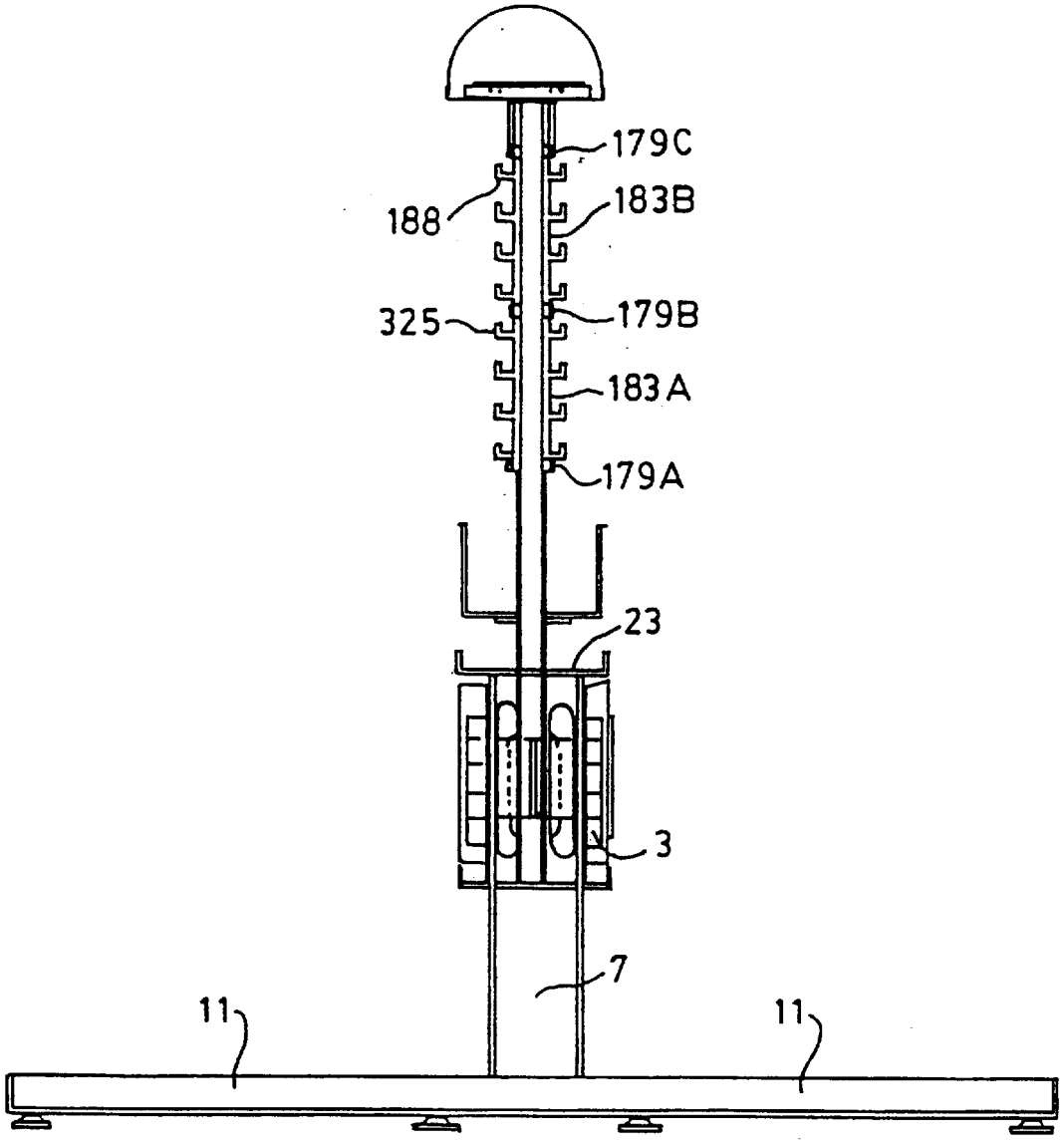
FIG. 8 is an end view of the beam with a supporting wall mounted thereon and support legs for mounting the beam above floor level.

In the preferred work station, as illustrated, the legs 7 rest on horizontally extending feet 11 which can have threaded levellers 15. The feet 11 can extend horizontally on one side of the beam 3 as shown in FIGS. 1 to 3 or the feet can extend outwardly on both sides of the beam 3 as shown in FIG. 8. The particular version of feet that will be used in the work station depends on the required balance for the particular work station system 1.

The preferred beam 3 has opposing long, vertical sides 19 and it is between these sides that the legs 7 extend. A tray 23 is formed on top of the beam and it is bounded on opposite sides by upwardly extending flanges 75, which flanges extend the length of the beam and have a series of connecting holes formed therein.

Figure 5:
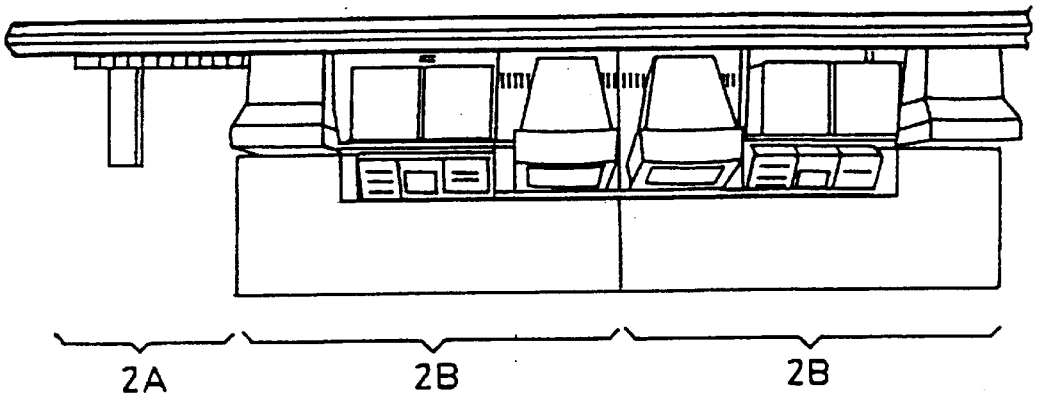
FIG. 5 is a plan view of the work station of FIG. 1.

The work station system 1 can comprise a series of separate modules 2 which can be connected together in end to end fashion or at an angle to each other as described further hereinafter. FIG. 5 illustrates how a single work station, the width of which is indicated at 2A in FIG. 5, can be connected with one, two or more double work stations 2B to form a desired configuration for a particular user.

As shown in FIGS. 1 to 3, each work station system 1 can include the basic elements of a beam support structure indicated generally at 4, a work area 5 which can comprise a number of horizontal work surface members 113 and a vertically extending support wall 6 detachably mounted on top of the beam 3 and supported thereby. These basic elements are described in detail below together with the manner in which they are coordinated to form a very functional work station.

Preferably a cover panel 27 extends across the face of each long side 19 of the beam. Each long side has a series of access openings 31 in which electrical boxes, for example box 35, can be placed and secured to the long sides 19. Electrical outlets 39 are placed in these boxes 35 in the normal manner for standard AC electrical installations. The outlets 39 extends through holes 43 in the cover panel 27 and are covered by suitable cover plates such as the illustrated plate 47. It will be understood that the beam 3 acts as a conduit for high voltage electrical cable, for example 120 volt cable.

Preferably, a ventilation cover plate 51 is secured to the underside of the beam at the front side thereof. This plate is covered with a grid work of numerous holes 55 to provide ventilation through the plate which is typically formed from sheet metal. Extending downward from the plate 51 is a optional flexible kick plate 59 which can be formed from extruded vinyl. If desired, the kick plate 59 can form a living hinge which enables an installer or repairman to have easy access underneath the beam 3 by simply pushing back or pulling forward the kick plate 59. This access may be required, for example, to permit cable to be installed through the floor (not shown). The plates 51, 55 serve to hide from view any cables that extend beneath the beam 3. An open mesh cable basket 67 can be hung from one side of the beam 3 below the work area but above the floor in order to catch loose hanging or dangling cables. Each basket 67 can be hung from two or more vertically extending wires 71 that have a hook formed at their top ends. Each hook 71*a* extends around the beam connecting flange 75. The baskets 67 will not interfere with a user's legs as they are located well back from the work surface members 113. The open mesh basket 67 provides the work station with a better appearance and allows cleaning staff to vacuum all the way underneath the modules. These baskets also allow service people better access beneath the beam which can be useful, for example, when feeding high voltage cable into the bottom of the beam.

The preferred extendible support brackets for the work station 1 will now be described in detail with particular reference to FIGS. 9 to 13. These support brackets 81 are provided for the purpose of supporting the work surface members 113 or similar horizontal supporting members. They include an elongate arm section 89 having a rearward portion 97 and a forward portion 93 that is slidably adjustable with respect to the rearward portion and connected thereto. The length of the arm section can be varied as required for a particular work station system. In the illustrated preferred embodiment, the arm section 89 is telescoping, that is the forward portion 93 is mounted in a telescoping manner in the rearward portion 97. The support bracket also has an arm supporting section 85 that hooks to the beam connecting flange 75 and that extends generally perpendicular to the length of the arm section 89. The supporting section 85 is rigidly connected to the rearward portion 97 as shown in FIGS. 11 and 13. This supporting section 85 in the illustrated preferred embodiment has a height which is at least twice the vertical width of the arm section 89. It can have an inwardly sloping front edge 85*a* to reduce the possibility of leg interference while still providing substantial support to the arm section.

The support bracket also has an upwardly and forwardly extending front section 109 which is rigidly connected to the forward portion and has an elongate top 109*a* for engaging and supporting the work surface member or supporting member 113. The front section has means for attaching the work surface member or supporting member 113 thereto. As illustrated, the front section 109 is fixedly connected to an upper flange 95 of the forward portion 93. Preferably two tie brackets 121 are provided on the front section 109. These brackets 121 can be used to connect adjacent support brackets together at the end of each module 2, the brackets being connected by means of bolts or other fastening devices. It might be noted here that when the end of one module 2 butts against the end of another module 2, their respective beams 3 are attached to one another by bolts or other fastening devices (not shown) using connecting flanges 117 formed on the end of each beam section. It is also noted that each work surface member 113 extends between two of the support brackets 81 and rest on top of their front sections 109. Holes for bolts or screws are provided in the upper flange 109*a* for connecting the work surface member to this upper flange. The work surface members 113 as shown in FIG. 1 extend across two modules 2 and the members 113 can be made sufficiently strong and rigid so that no additional support bracket 81 is required to support the middle of the work surface member. Where there is no support bracket 81, normally no leg 7 or foot 11 is required. It will be appreciated that the distance that the beam 3 and each work surface member 113 can span without support is dependent upon the specific design of a given work station system, including the materials that are used and the loads to be carried by the system.

The versatility and advantages of the described support brackets 81 become quite evident when one considers that, although LCD or other flat panel monitors are currently very expensive, there is an increasing trend towards such monitors (not shown). Clearly, flat panel monitors take up less space and they also consume less energy and generate less heat. When flat panel monitors become common and are used on an extensive basis, users will want narrower work station modules too (that is, in a front to rear direction). Of course, technological innovation may change the current pattern and require additional space and the telescoping support brackets described herein allow for this expansion. By providing telescoping support brackets, existing work station modules 2 can be adjusted to future conditions and this decreases the investment risk for a purchaser of such modules while increasing the value thereof.

Figure 12:
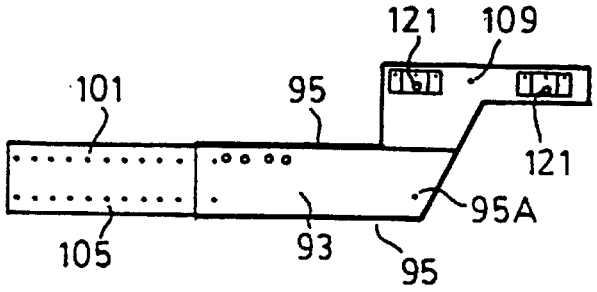
FIG. 12 is a side view of a forward portion of the support bracket of FIGS. 9 and 10.
Figure 13:
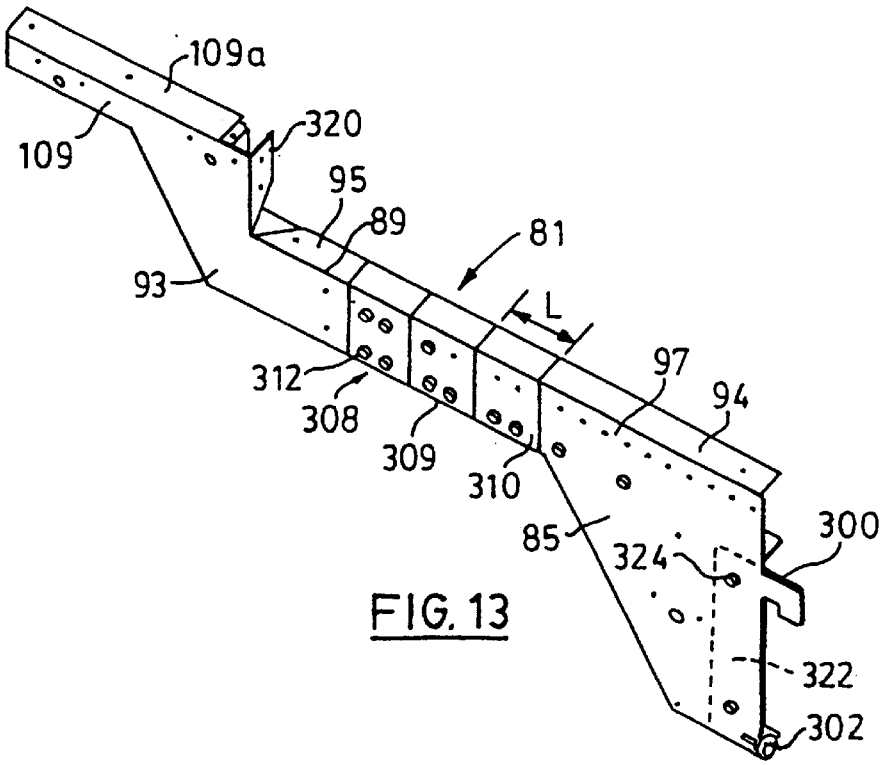
FIG. 13 is a perspective view taken from above and towards the rear of a preferred embodiment of the extendible support bracket.
Figure 14:
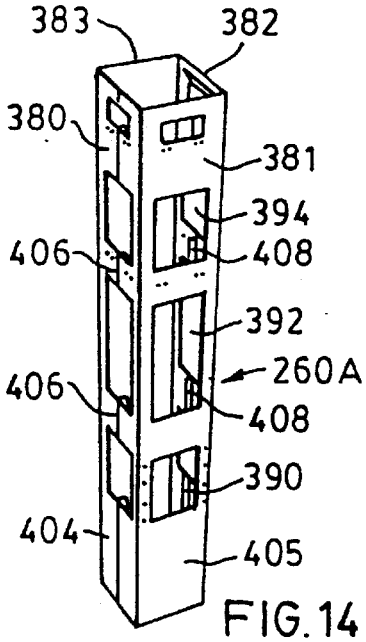
FIG. 14 is a perspective view of a 90 degree or four sided junction post for use with the work station system of FIG. 1, this view being taken from above and showing two vertical sides.
Figure 15:
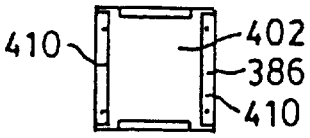
FIG. 15 is a top view of the junction post of FIG. 14.
Figure 16:
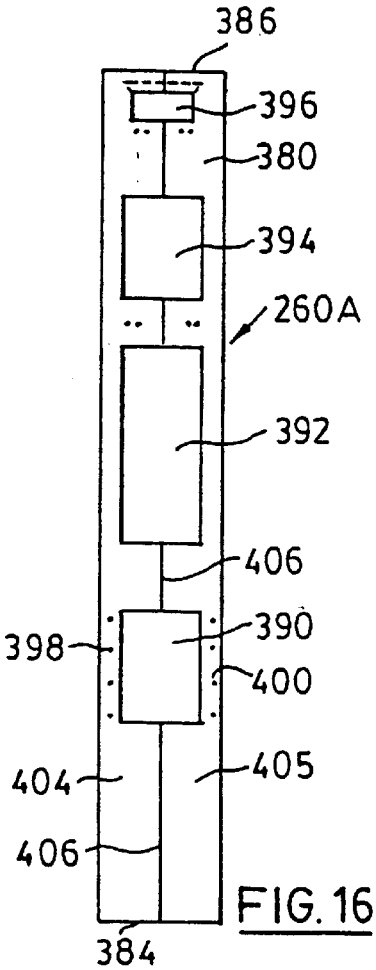
FIG. 16 is a side elevation of the junction post of FIG. 14.
Figure 17:
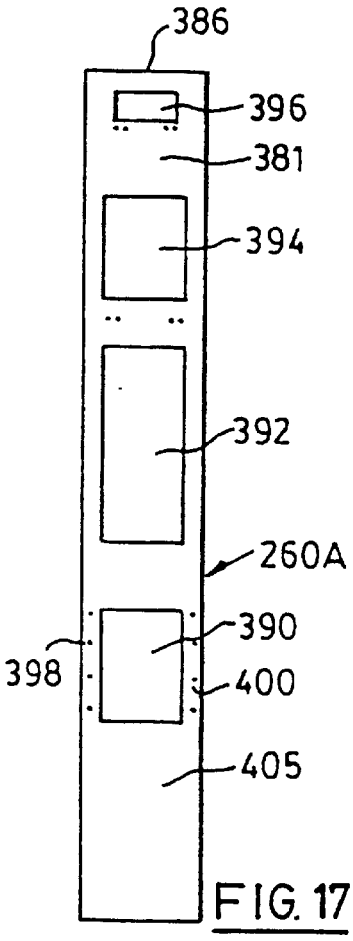
FIG. 17 is an elevational view showing the right side of the junction post of FIG. 16.

As shown in FIG. 12, the forward portion 93 is formed with two opposing series of holes 101, 105 that are distributed lengthwise along the rear section of the forward portion in a straight line. The holes 101 constitute an upper series while the holes 105 constitute a lower series located on the vertically extending section. The rearward portion 97 has two upper holes 98 which are aligned with the series 101 and two lower holes 99 which are in alignment with the series 105. Again, it will be appreciated that the rearward portion could have as few as two bolt holes which would be in alignment with the two series of bolt holes in the forward portion. Threaded fasteners, preferably four, such as bolts or other known fastening devices (such as rivets, not shown) are provided with the support bracket and extend through transversely aligned holes of the bolt holes 98, 99, 101 and 105 in the forward and rearward portions in order to secure the forward portion 93 in a desired fixed position relative to the rearward portion. In order to take full advantage of the telescoping feature of the support bracket, it is recommended to use detachable fastening devices such as bolts and cooperating nuts. After these devices have been removed, the forward portion 93 can be moved towards the beam 3 to the position shown in FIG. 9 so that the overall length of the support bracket is shortened. The fasteners are then secured in place. If one wishes to extend the support bracket, the fasteners would again be removed and the forward portion 93 extended to the position shown in FIG. 10, thus increasing the overall length of the support bracket.

The preferred support bracket is provided with a rearwardly projecting hook member 300 which enables the support bracket to be hooked to the beam connecting flange 75 in a manner known per se. In the embodiment of FIG. 13, the hook member 13 is constructed of two or three layers of sheet metal (ie. 11 gauge steel—0.12 inch thick) in order to provide it with the desired strength. Preferably, both the forward portion 93 and the rearward portion 97 of the bracket are substantially channel-shaped elongate members with upper and lower flanges that extend horizontally during use of the support bracket. The flanges 94 of rearward portion 97 extend at right angles to a center part 94*a* forming a "C" configuration in vertical cross-section. Similarly, the flanges 95 on the forward portion 93 extend at right angles to a center part 95*a*. A rear section of center part 95*a* is slightly smaller in width then the center part 94*a* so that the forward portion 93 can slide snugly in the rearward portion 97. The lower flange 94 of the rear portion 97 is fixedly connected to the arm supporting section 85 which can also be provided with a tie bracket 121*a*.

In a manner known per se, the bottom of the support section 85 is fitted with a metal leveller 302 which can be threaded into or out of a coupling nut mounted in the section 85 in order to make the upper supporting surfaces of the bracket level. Also, in order to retain the bottom of section 85 in place, an optional flat retaining plate 304 can be provided and can be secured by two tapping screws (not shown) to a horizontal flange 306 formed on the bottom of the section 85. As shown in FIG. 13, the plate 304 can be omitted from the support bracket, if desired.

In the preferred bracket of FIG. 13, there are three short, channel-shaped mid-arm extension members 308 to 310 which can be attached to outer surfaces of the forward section 93 by means of tapping screws 312 or cap screws and nuts. These optional trim members can be used to fill in the slight recess that is left by extending the support bracket and they also help to strengthen the extended bracket. The number of the extension members used would depend upon the amount of the extension of the support bracket and the size of the members. In one preferred embodiment, the support bracket is extendible in increments for a total possible extension of 6 inches (for example to accommodate a very large console). For this embodiment, the length L of each extension member is 2 or 3 inches. By using these extension members, both the upper supporting surface created by the flanges 94, 95 and the outer vertical side of the bracket have a smooth, pleasing appearance.

The forward portion 93 of the bracket can be provided in different lengths. In particular, the rear section having holes 101, 105 can vary in length depending upon the anticipated job requirements. If the job requirement should change, then the existing forward portion can be replaced by a longer or shorter one while still using the same rearward portion 97. Also, if a shorter bracket is now required, it may be possible for the user to simply cut-off a portion of the rear section of forward portion 93, leaving sufficient holes 101, 105 for proper re-attachment of the forward portion 93 to the rearward portion of the bracket.

It will be appreciated that the upper flanges 95 of the forward portion and the upper flanges 94 of the rearward portion together form a substantially flat, upper supporting surface (with or without the extension members 308, 310) that extends rearwardly from the front section of the bracket and that is adapted to support equipment at a height below the height of the elongate top of the front section 109.

Figure 9:
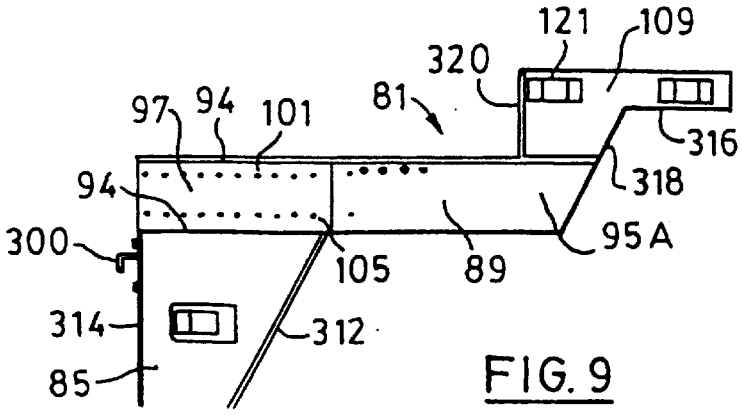
FIG. 9 is a side view of a support bracket for the work station, this bracket being shown in a shortened position.
Figure 10:
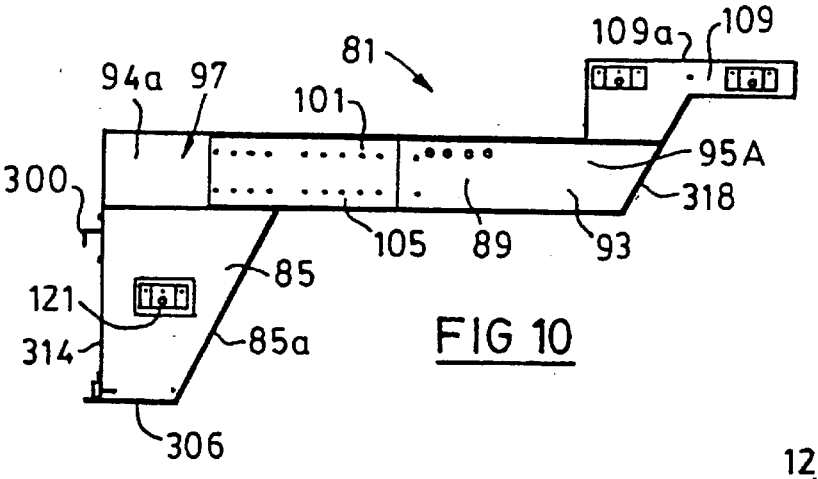
FIG. 10 is a side view of the support bracket which is shown in the lengthened position.
Figure 11:
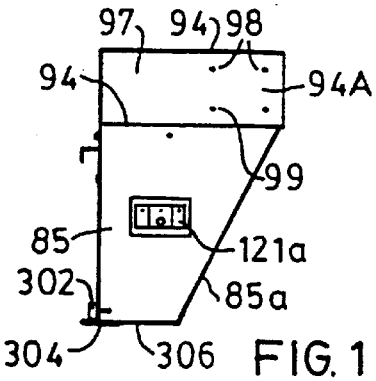
FIG. 11 is a side view of a rearward portion of the support bracket.

In addition to the flanges already mentioned, the supporting section 85 illustrated in FIGS. 9 to 11 includes a front edge flange 312 and a rear flange 314 in order to provide increased rigidity to this supporting section. The front section 109 also has a lower, horizontal flange 316. A further sloping flange 318 extends upwardly from the bottom of forward portion 93 to the rear end of the flange 316. In addition, the front section 109 can have a rear flange 320. All of these flanges extend from the same vertical side of the support bracket.

The preferred embodiment shown in FIG. 13 is similar to that of FIGS. 9 to 12 but the supporting section 85 has no rear flange 314. Instead, a flat, generally rectangular reinforcing plate 322 is attached to one side of the main sheet metal plate forming the supporting section 85. The top and front edge of this reinforcing plate is indicated in dashed lines in FIG. 13. In the preferred embodiment, the plate 322 actually comprises two side-by-side sheet metal plates and the plate includes a hook portion that forms part of the hook member 300. The plate 322 can be attached to the main plate by means of spot welding together with two cap screws 324 and nuts (for safety purposes).

The work station configuration 1 shown in FIGS. 1 to 5 has been found to be a very good general purpose configuration for securities and investment trading operations. The beam 3 is made up of standard beam sections having lengths from 18 inches to 36 inches and these sections can be connected together in unsupported lengths of up to 10 feet. The particular design of any work station system 1 and its configuration will depend on the requirements of the user and the specific materials and forming techniques used.

Mounted in the well behind the work surface members 113 is a support shelf 129 which extends between adjacent arm sections 89. This shelf is formed from sheet metal or the like. Preferably the shelf member 129 is bent at a right angle so that the vertical portion thereof rests against the rear of the front section 109. Preferably the support shelf has a support rail (not shown) under a rear edge 133 thereof, which rail allows the shelf and in particular its back edge to support substantial equipment loads.

Turning now to the supporting wall 6, this wall extends vertically and preferably is mounted on the beam by means of rigid, vertical support columns 137 that extend through openings 141 formed in the top of the beam in the area of the tray 23. Preferably each column 137 is made up of opposing C-shaped or channel shaped frame members 145 connected by spot welding, rivets or other fastening means (not shown) through respective center portions of the frame members. Thus, each column 137 is H-shaped in cross-section.

Figure 6:
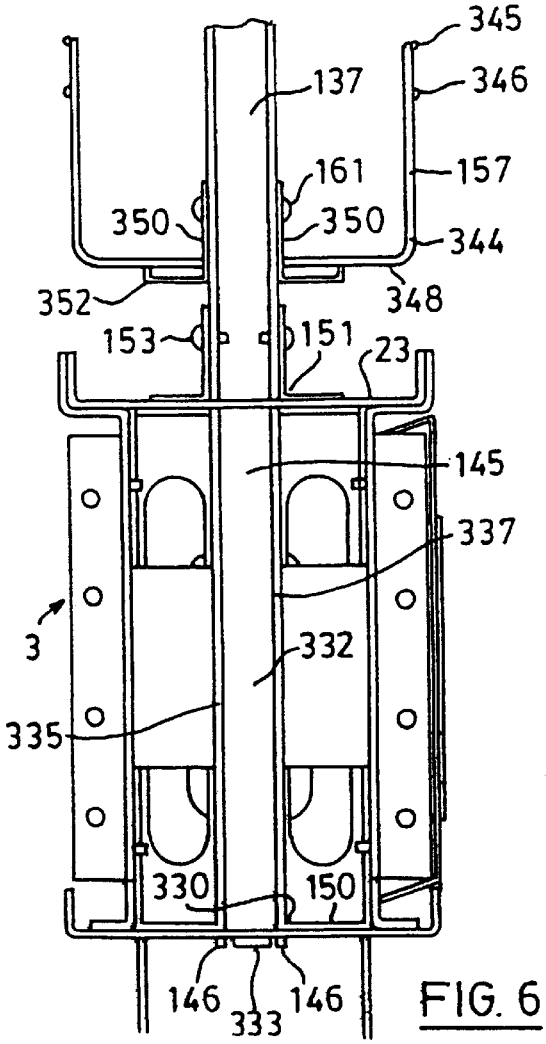
FIG. 6 is an end view of the beam used in the work station showing the lower portion of a support wall mounted thereon and a raceway for wiring and cables.

The manner in which each column is mounted in the beam 3 is shown generally in FIG. 6. The beam 3 includes a horizontal bottom plate 150 spaced a significant distance (ie. about 8 inches) below the top of the beam which forms the tray 23 and having suitable, central receiving holes 330 formed therein for receiving the bottom ends 146 of the columns. The bottom ends 146 are positioned in these receiving holes so that the bottom ends are secured from horizontal movement by the bottom plate 150. In one embodiment of the column 137, the edges of the center portion 332 of the column at the bottom of the column are bent outwardly so that the bent end tabs can be attached by screws to a small connecting plate 333 that extends across the center of the hole and is attached to the bottom of the beam by screws (not shown). In this version, each hole 330 is a substantially square hole and the bottom ends 146 project through this hole on either side of the flat connecting plate 333. The ends 146 are formed by the ends of the parallel legs 335, 337 of each frame member 145.

Figure 30:
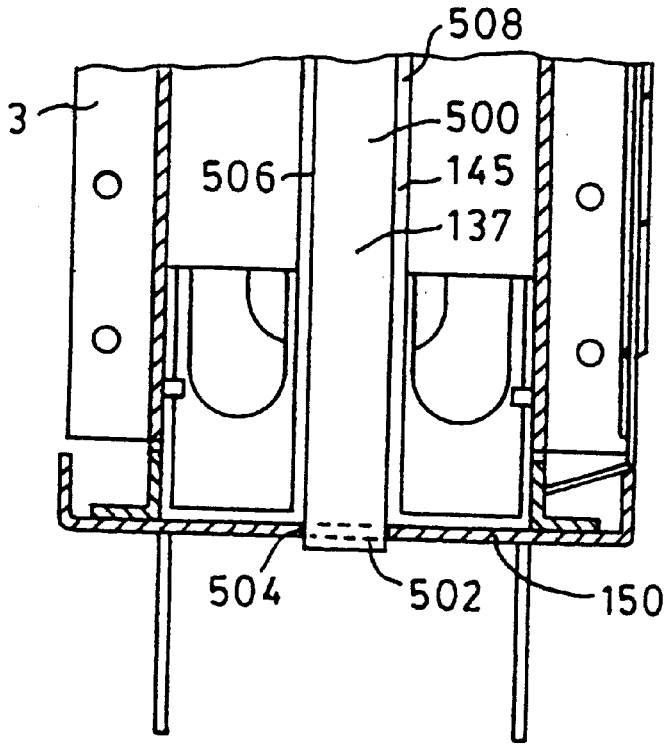
FIG. 30 is a transverse vertical cross-section of the beam showing a preferred form of connection for a support column of the support wall.

The preferred mounting for the bottom end of each column 137 is shown in FIG. 30. In this version, the central web section 500 of each frame member 145 has a bottom end section 502 that extends through a narrow rectangular slot 504 formed in the bottom plate 150 of the beam. Because the two end sections 502 have combined horizontal dimensions which are the same as those of the slot 504, the column 137 must be driven into the slot when installed, thus creating a very tight, force fit that effectively prevents any looseness in the wall mounting. The bottom ends of the parallel legs 506, 508 of the column rest on top of the bottom plate 150 and thus support the column in the vertical direction.

The support columns 137 are detachably connected to the top of the beam by means of brackets or angles 151 which can be fastened to the tray 23 at the top of the beam by tapping screws (not shown). The brackets are connected preferably by threaded fasteners 153, which may be tapping screws, to their respective columns 137. In this manner, the columns are prevented from being pulled upwards and the brackets also help prevent lateral movement of the wall. It will be appreciated that fixing each column 137 at two points separated by a significant vertical distance, in this case the depth of the beam 3, provides significant anti-rotational strength to the column to prevent it from tipping. This is very important where the support wall 6 is to carry significant loads including load bearing members such as those that will be described hereinafter. As described in the applicant's U.S. Pat. No. 4,838,177, the legs 7 are fixed at least at the top and bottom of the beam 3. With this rigid structure, including the support wall 6 and the beam structure 4, a stable vertical core is formed and from this core the work area 5 extends.

The support wall 6 includes at least one rigid, metal side panel 183 forming one side of the support wall with means provided thereon for attaching the aforementioned load bearing members. The metal side panel is mounted on the support columns 137. In the illustrated preferred embodiment, there are two such side panels located on both the front and the rear sides of the support columns. Mounted at opposite ends of the panels are end columns 165 which are shorter than the columns 137 and do not extend into the beam. As shown in FIGS. 2, 3 and 8, metal buttons fasteners 179A extend from the columns 137, 165. The front panel 183 as shown comprises a lower wall panel section 183A and an upper wall panel section 183B. In assembling the support wall, the lower section 183 is first slipped snugly over lowermost buttons 179A and then the top of the section 183 is secured by the higher buttons 179B on the columns. Then, the upper section 183B slips over the buttons 179B and is subsequently secured at the top by uppermost buttons 179C located near the top of the columns. After attachment of the upper section 183B, a cover plate 187 made of sheet metal is installed along the top of the support wall and covers the buttons 179C and the vertical portion of a tie angle 174, the purpose of which is described hereinafter. Each of the sections 183A and 183B is formed with attaching means preferably in the form of a number of integral, horizontal L-shaped connecting flanges 188 located on the outer surface of each side panel section. As shown, these flanges 188 extend parallel to one another and are spaced uniformly apart a relatively short distance (ie. 1½ inches) from adjacent flanges. As shown clearly in FIG. 8, each flange has an upwardly extending leg 325. The panel sections and the flanges are preferably made from aluminum or aluminum alloy and they are formed by extrusion.

Figure 31:
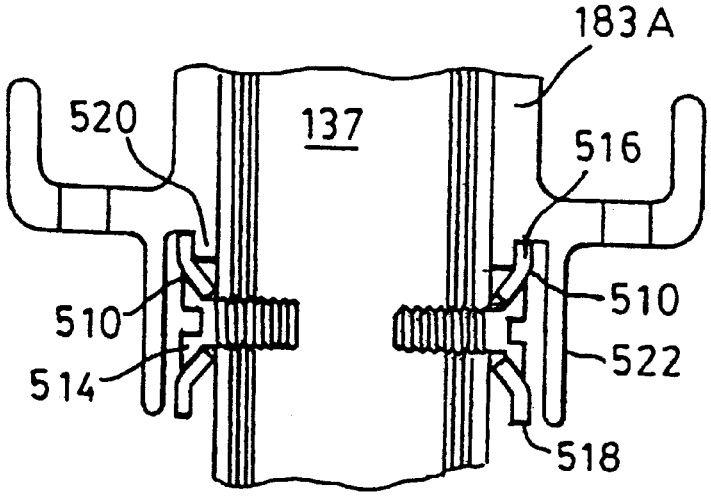
FIG. 31 is a detail end view showing the preferred clips used to attach the panel sections of the support wall.
Figure 32:
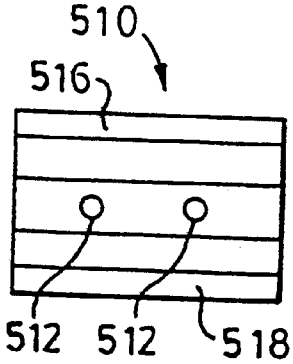
FIG. 32 is a front view of one of the clips shown in FIG. 31.

A preferred mechanism for attaching the panel sections 183A, 183B is shown in FIGS. 31 and 32. Instead of using the aforementioned buttons 179A, B, C, the panel sections are attached to each column 137 by means of short metal clips 510 provided with two side-by-side holes 512 to receive two screws 514. Each clip 510 is shaped to have two horizontally extending edge flanges 516, 518 that are spaced from the adjacent side of the column 137. The clips 510 are used to attach the panel sections in a manner similar to the aforementioned buttons with the bottom clips 510 being attached to their respective columns first. A short bottom flange 520 formed on each panel section is inserted behind the upper flanges 516 of the clips as the panel section is set in place. Then further clips 510 are secured to their columns in order to hold the upper edge of the panel section. The use of two screws 514 to hold each slip is advantageous as it ensures that the clip is properly aligned when secured to the column. Also note that the preferred panel sections each have a short, downwardly extending, integral cover section 522 which serves to cover the adjacent clips 510 and provides a cleaner appearance.

As shown in FIGS. 1 to 3, in the preferred work station, a bottom edge 340 of each metal support panel 183 is spaced above the top of the beam 3 so as to leave a substantial open space 342 between the metal support panel and the beam. This space permits wiring and cable to extend through the center core, for example, from the front to the back of the work station or vis versa. Moreover, because the space 342 can be positioned below the top of the work surface members 113 and behind equipment, it may be hidden from view and therefore not detract from the appearance of the work station.

In a preferred embodiment, an elongate open mesh wire and cable raceway 157 is mounted on the support wall 6 and is located in the open space 342 and this raceway extends generally horizontally along the support wall in a direction parallel to the support beam 3. Thus, the raceway is above the beam 3 and below the level of the support shelf 129 and preferably each section of the raceway extends the width of the work station module 2 as shown clearly in FIG. 4. Preferably, the raceway is detachably connected by bolts or other fastening means 161 (see FIG. 6) to the columns 137. The raceway is also connected to bottom ends of the end columns 165 by bolts or other fastening means 169. One form of the raceway 157 is shown in detail in FIG. 6. In this version, an outer section 344 extends vertically and is spaced apart from the columns 137, 165. The section 344 has two horizontally extending wires 345, 346 near or at the top thereof. The bottom of the raceway is formed by short, horizontal wire sections 348 which are connected at their inner ends to a substantially L-shaped metal rail 350. The vertically extending leg of this rail is connected by the fasteners 161, 169 to columns 137, 165. Each rail also has a horizontally extending section 352 which helps support the wire sections 348 near their midpoint. In an alternative version, the L-shaped rails 350 are turned upside down so that their vertical leg extends downwardly from the wire sections 348 and the horizontal legs 352 extend above the wire sections 348.

Because the raceway 157 is made as an open mesh, it is easy for service people to see and identify the low voltage cables, such as communication cables and telephone and network cables and it is easy for these service people to feed these cables to and from the raceway towards the front or the rear of the module at any desired location, for example, for network drops at individual work stations 2*a* or 2*b*. Also, the open mesh of the raceway does not block air circulation, allowing for better natural convection cooling through the interior of the system 1.

Figure 7:
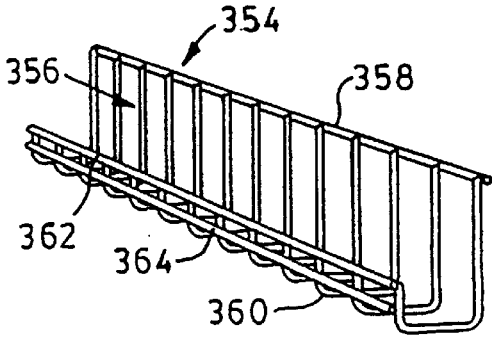
FIG. 7 is a perspective view of a preferred form of wire mesh raceway.

The second preferred version 354 of the raceway shown in FIG. 7 has an outer section 356 with a single, horizontally extending wire 358 forming a top edge. The raceway is constructed with a number of J-shaped wire sections 360 which are spaced apart and parallel to one another. These sections are connected together at their inner ends by two horizontal wires 362, 364 and it is these wires that are connected to the columns 137, 165. Bolts or threaded fasteners (not shown) that extend between horizontal wires 362, 364 are used to secure the raceway 354 in place. Preferably, a nylon washer is placed around and behind the head of each bolt or fastener and the adjacent sides of wires 362, 364 to provide a suitable supporting surface. It will be appreciated that the raceways 157, 354 are intended for the passage of low voltage cables and wiring, separating them from higher voltage cables that extend through the beam 3.

The preferred work station with the wall 6 has a cap 176 rigidly mounted along a top edge of the support wall. As shown, this cap can project horizontally from opposite sides of the support wall. In order to support the cap, the top end of each end column 165 is secured to a tie angle 174 which is also secured to the columns 137. The tie angle extends outwardly at right angles to the columns ending in an upwardly extending lip 175. The cap 176 rests on the tie angle and is retained by the lip. The cap 176 is secured in place by a bracket 178 located at each end of the cap, this bracket being mounted on opposing ends of the tie angle. The cap can be formed of any of several different materials including metal, wood and plastic and the shape of the cap can vary from the semi-cylindrical shape shown in the drawings. For example, instead of a semi-cylindrical cap, the cap can be provided with a flat top and downwardly and outwardly sloping sides at the front and rear of the wall. It will further be appreciated that other forms of connections can also be used to mount the cap on the top of the wall. For example, the aforementioned flat-topped cap could be mounted on a channel-shaped member which is open at the top and which has a horizontal web that is bolted to a suitable horizontal connecting member extending along the top of the columns. The elongate cap member is secured to connecting flanges that extend along the top edges of the channel member. The channel member's horizontal section is secured to the top wall. The caps can be made in a variety of decorative colours to enhance the appearance of the work station.

Figure 4:
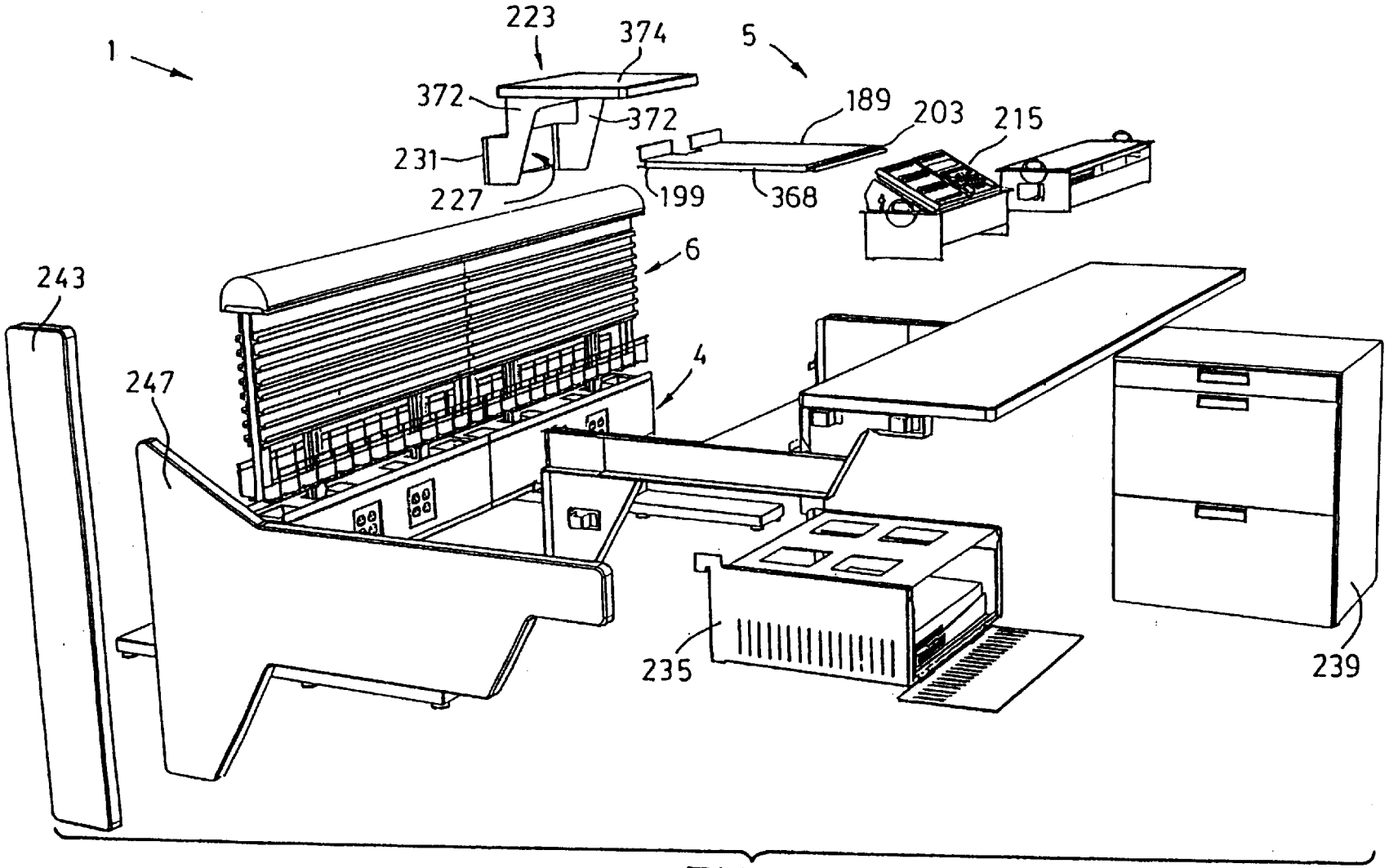
FIG. 4 is a partially exploded perspective view of one embodiment of a work station incorporating various aspects of the invention.

As best seen in FIGS. 3 and 4, a planar support member or shelf 189 for supporting equipment such as monitors has rear brackets 191 located on either side of a cut-out 195. Beneath the brackets are standoffs 199 which extend rearwardly from the bottom of the shelf. The brackets 191 permit the shelf 189 to be hung from one of the connecting flanges 188 while the standoffs 199 can extend below the flange to an adjacent support surface such as the side of a column 137 in order to prevent the shelf 189 from pivoting downwardly during installation. Although the shelf 189 is shown in the drawings as being fairly narrow from one side edge 368 to the opposite side edge, it will be appreciated that the shelf can be made as wide as required for the work station and, for example, the shelf can extend from one support bracket 81 to an adjacent support bracket. A forward edge 203 of the shelf can be supported by the support shelf 129 or, if it is desired to raise the shelf 189, suitable support extensions (not shown) can extend between the bottom of the shelf 189 and the top of shelf 129.

Electrical equipment indicated generally at 207 can be placed on top of the shelf 189 or on the shelf 129. The cutout 195 allows for power and communication cords and wires for the equipment 207 to reach above the top of these two shelves. The equipment 207 can be such items as monitors 211 or telephone turrets 215. Where there is unused space between the equipment 207 and work surface members 113, a planar spacer member 219 which forms additional work surface can be supported above the shelf 129 in any suitable manner, for example, by vertically extending wall members 370, one of which is shown in FIG. 2. These wall members can be attached to the bottom of the spacer 219.

As shown in FIG. 4, the work station can also be provided with one or more self-supporting shelves 223 provided with a bracket 227 adapted to hang from one or more of the horizontal flanges 188 of the support wall. This shelf can be used to support electrical equipment such as a monitor. A back 231 of the bracket 227 comes into contact with the front face of several flanges 188 below the top of the shelf 223, thus preventing the shelf from pivoting downwardly. The illustrated shelf has two support arms 372 that extend upwardly and outwardly to the horizontal panel or board 374 on which the equipment rests. The arms 372 transfer the load or weight of the equipment to the support wall 6 which, as indicated, is rigid and self-supporting. In one version of this shelf, a set screw is mounted in the bracket 227 in order to safely secure the shelf 223 to the support wall. The screw is turned until it extends under an adjacent flange 188, thus preventing upward displacement of the shelf unit.

In addition to hanging components and shelves from the wall 6, it is also possible to hang other components from the beam 3, for example, by using the connecting flange 75. For example, computer equipment boxes 235 and filing cabinets 239 can be hung from or attached to the beam, if required. Also, column end covers 243, one of which is shown in FIG. 4, and work end covers 247 can be attached to exposed ends of the work station modules to produce a pleasing aesthetic appearance. The illustrated cover 243 can extend from the bottom of the leg 7 to the top of the support wall 6 while the cover 247 can extend from one side edge cover 243 to the front edge of work surface member 113. It will also be appreciated that a further trim cover or trim covers (not shown) can be attached to the rear side of the work station, that is the rear side of the wall 6 and the beam 3 if the rear side will be exposed to view and it is not to have a work area 5 extending therefrom. Although this description has been made with reference to a work area 5 being provided only on one side of the beam 3 and the wall 6, it will be appreciated that a similar work area 5 could be provided on the other side of the beam 3, this work area also being supported by the beam.

It will be further understood that although only one height for the support wall 6 is illustrated, different lengths of columns 137 and different heights of support walls can be used in the work station system 1. If no substantial wall or barrier is desired behind the equipment or work surfaces, then the columns 137 and the support panels attached thereto can be reduced in height to leave only a single horizontal flange 188 for supporting the rear of the shelf 189. On the other hand, if greater carrying capacity or a full barrier is desired, then the columns 137 can be lengthened and more panel sections attached to the columns to provide the required height and additional connecting flanges 188.

FIGS. 14 to 29 illustrate various embodiments of junction posts that can be used to connect adjacent ends of the work stations of FIGS. 1 to 5 together. Referring to the 90 degree three-way junction post shown in FIGS. 14 to 17, this post comprises a vertically extending hollow column 260A having four vertical sides 380 to 383 extending between a bottom end 384 and a top end 386. The bottom end 384 is adapted for supporting the column on a level, substantially horizontal surface and is preferably provided with four levellers 388 shown in detail in FIGS. 18 and 19 but not in FIGS. 14 to 17. At least two of the vertical sides of the column are formed with a relatively large bottom aperture 390 spaced from the bottom end of the column and at least one upper aperture 392 for the passage of wiring and cables positioned above the bottom aperture. In a preferred version of the post, the bottom of the aperture 390 is more than 8 inches above the bottom end of the post and preferably about 11 inches from the bottom end. In the preferred embodiment of FIGS. 14 to 17 there are three vertical sides 380, 381 and 382 each of which has a bottom aperture 390 and three upper apertures including the relatively large aperture 392. The additional rectangular apertures on each of these three sides are indicated at 394 and 396. The large aperture 392 can, for example, be used to pass low voltage wiring and cables through the column from one adjacent raceway 157 to another adjacent raceway 157.

Attachment means are provided on at least two vertical sides of the column (and in the preferred embodiment of FIG. 14 on the three sides 380, 381 and 382) for connecting adjacent ends of the elevated, hollow work station beams 3 to the sides of the column. Preferably these attachment means comprises a series of bolt holes 398 and 400 located on opposite sides of each bottom aperture 390. During use of the junction post 260A the adjacent beam ends are positioned and connected next to the bottom apertures 390 so that the adjacent beam ends open into the interior space 402 of the column. Bolts, which extend through the holes 398, 400 and nuts are used to connect the side of the column to the connecting flanges 117 provided on the end of the beam (see FIG. 1). It will be noted that the junction post 260*a* extends a substantial distance above the adjacent beam ends and preferably extends the height of the supporting wall 6. It will also be understood that the column 260A is square in horizontal cross-section so that the four vertical sides 380 to 383 are of substantially equal width.

In the preferred embodiment illustrated, both the bottom apertures 390 and the upper apertures are rectangular and at least the bottom apertures 390 and preferably the upper apertures 392 as well have a width which exceeds substantially more than one half the width of the vertical sides of the column. In this way there is plenty of room to pass wiring and cables through the column both at the beam ends and at the height of the raceway 157. One preferred embodiment of the column is constructed substantially from two sheet metal channel members 404 and 405 that are connected together along vertical joints 406 by means of vertical, elongate connecting flanges formed therein, which flanges extend into the space 402. These connecting flanges 408 can be seen in FIG. 14.

The top end of the column can be formed with inwardly extending, horizontal connecting flanges 410 for mounting a suitable cap (not shown) on top of the post. The cap can have any desired configuration and preferably is designed to be compatible with the adjacent cap 176 on top of the support wall.

Figure 18:
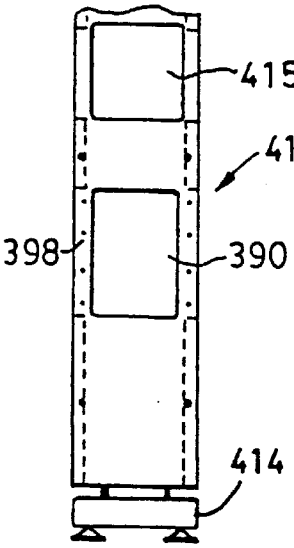
FIG. 18 is a partial elevation showing the lower half of another embodiment of the junction post.
Figure 19:
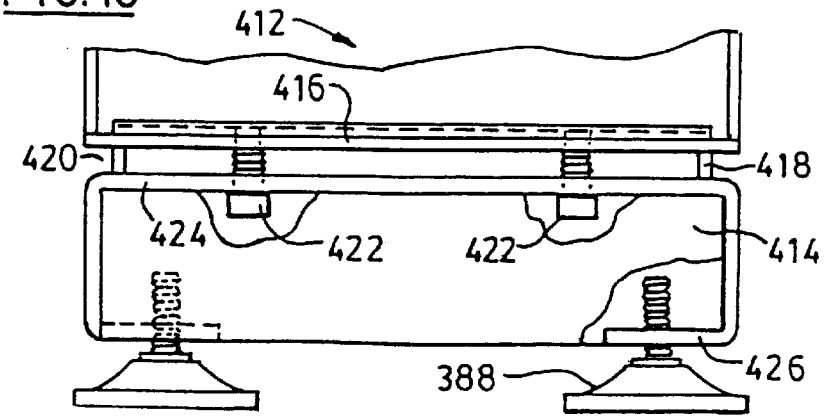
FIG. 19 is an elevational detail of the bottom end of the junction post of FIG. 18.

Turning now to the preferred 90° junction post shown in FIGS. 18 and 19, this post 412 is similar in its construction to the post 260A except for the differences noted hereinafter. Only the bottom half of the post 412 is shown in FIG. 18. The primary difference in this post is that it is provided with a separate post base 414 that is rigidly connected to the bottom end of the post. The purpose of this post base is to provide the junction post with an overall appearance that matches more closely the appearance of the adjacent work station including the feet 11 with its levellers 15. It will be understood that the height of the base is the same as that of the adjacent foot 11 (see FIG. 1) and it can also be of similar width. The base 414 is preferably fitted with four of the aforementioned plastic levellers 388 which make it possible to adjust the height of the post and to align its sides with the adjacent ends of the work stations.

In order to connect the base 414, the main body of the junction post is provided with a bottom plate 416 which is rigidly connected to the vertical sides 380 to 383. A thin spacer member 418 is provided between the plate 416 and the base 414 to create a short gap 420 for appearance purposes. Four tapper screws 422 inserted from below can be used to connect the base to the plate 416, these screws extending through holes in a top 424 of the base. The base 414 is formed with two inwardly extending bottom flanges 426 for threadably mounting the levellers 388. Another difference to be noted in the post 412 is that there is only one upper aperture 415 above the aperture 390 and it is shorter in height than the aperture 392.

Figure 20:
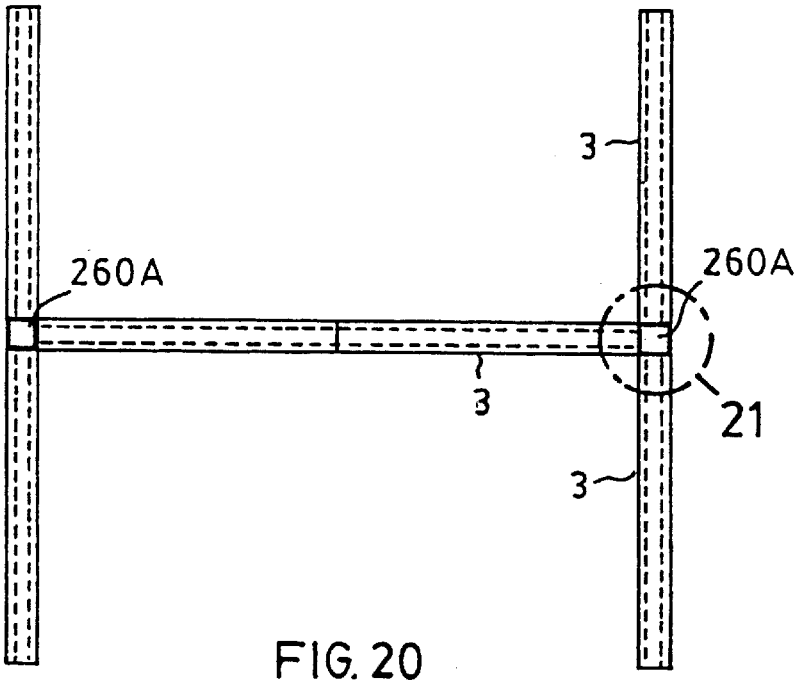
FIG. 20 is a plan view illustrating the use of the aforementioned junction post to connect the horizontal beams of the work station system.
Figure 21:
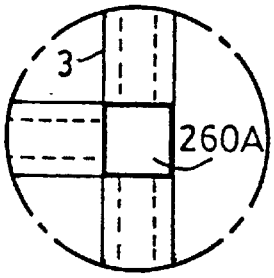
FIG. 21 is a detailed view of the area in circle 21 in FIG. 20 showing the top of a junction post with three beam ends being connected to the post.
Figure 22:
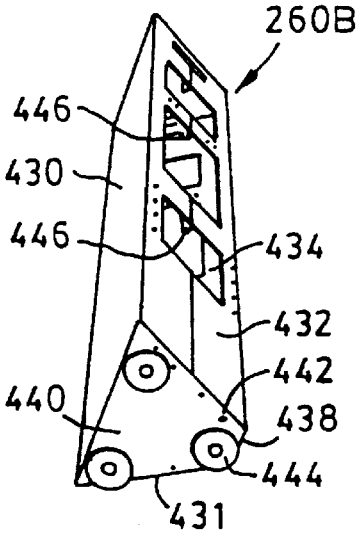
FIG. 22 is a perspective view of a 60 degree two way junction post for use with the work station system shown in FIG. 1, this view being taken from below.
Figure 23:
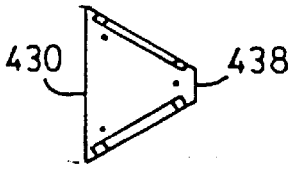
FIG. 23 is a top view of the junction post of FIG. 22.
Figure 24:
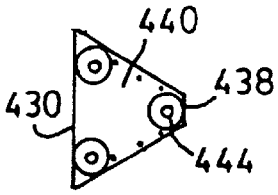
FIG. 24 is a bottom view of the junction post of FIG. 22.
Figure 25:
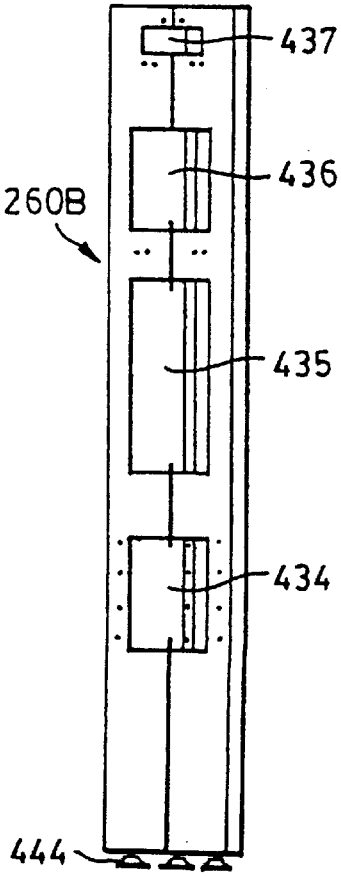
FIG. 25 is a side elevation of the junction post showing one of the two sides adapted for connection to a horizontal beam.
Figure 26:
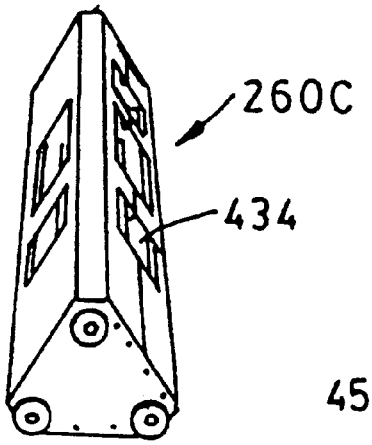
FIG. 26 is a perspective view of a 60 degree three-way junction post for use with the work station system of FIG. 1, this view being taken from below.
Figure 27:
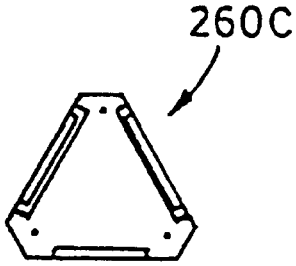
FIG. 27 is a top view of the junction post of FIG. 26.
Figure 28:
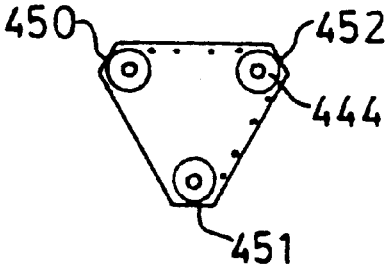
FIG. 28 is a bottom view of the junction post of FIG. 26.
Figure 29:
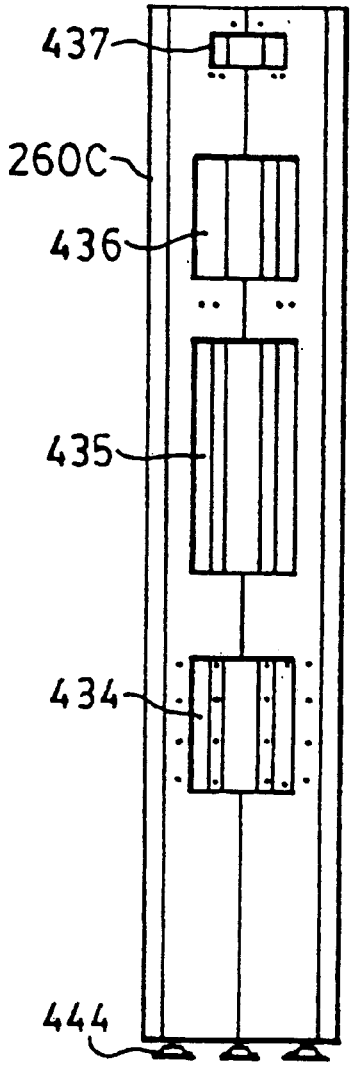
FIG. 29 is a side elevation of the junction post of FIG. 26, this view showing one of the three sides that can be connected to a horizontal beam.

FIG. 20 illustrates how the junction posts of FIGS. 14 to 19 can be used to connect the ends of three work stations together at 90° angles. For ease of illustration, only the beams 3 are shown in FIGS. 20 and 21 in addition to two junction posts. The illustrated configuration is that of 2 a letter H with one long beam 3 connecting the two junction posts 260A.

Turning to the embodiment shown in FIGS. 22 to 25, this junction post 260B has only three vertical sides 430 to 432 with each pair of adjacent vertical sides forming an angle of about 60° in a horizontal plane. The side 430 has no openings formed therein while the sides 431, 432 each have a bottom aperture 434 and three rectangular upper apertures 435 to 437. At least the large aperture 435 is provided for the passage of wiring and cables between the raceways 157 of adjacent work stations. Again, two adjacent beam ends can be connected to the two bottom apertures 434. The corner where the two sides 431, 432 meet can be truncated to form a flat connecting surface 438 in order to reduce the possibility of interference, for example, between connecting bolts, when the work station ends are connected to the post.

In this embodiment, there is a bottom plate 440 that forms the bottom end of the post and is attached to the vertical sides, for example, by two or more connecting flanges formed on the sides. Tapping screws indicated at 442 can connect the plate to these flanges. In one embodiment, four such screws are used. Adjustable levelling devices 444 are mounted on the bottom plate to permit the post to be levelled. In a preferred embodiment, there are three such levellers formed of black plastic. The post 260*b* can be constructed from sheet metal members which are welded together at connecting flanges 446. The post 260*a* and 260*b* can come in a variety of heights ranging, for example, from about 28 inches to 66 inches.

Turning now to a further variation of the junction post shown in FIGS. 26 to 29, this junction post 260C also has three major vertical sides with adjacent sides being arranged at a 60° angle relative to each other. However, in this embodiment, all three vertical sides are formed with rectangular apertures, including a bottom aperture 434 and three upper apertures 435 to 437. Each of the three vertically extending corners in this embodiment is truncated, thus forming three narrow connecting surfaces 450 to 452. It will be appreciated that three ends of adjacent beams 3 can be connected to the three openings 434 of this post so that work stations extend in three directions from this post.

It will thus be seen that the work station system 1 described herein is constructed so as to be highly flexible in physical layout, equipment handling and support and in cable and wiring handling. Further, the system is able to provide substantial structural support for carrying equipment and work areas with minimal obstructions. There is relatively open access for capable management and the system provides for separation between high voltage cables which can be led through the main beam and low voltage communication cables. Also, the system can be constructed so that it is sufficiently open to allow for natural convection and air circulation. As described above, the system can be used in conjunction with a variety of structural, supporting and junction elements which can be used to create a comfortable yet functional furniture system.

It will be readily apparent to those skilled in the art of constructing work stations and furniture systems that various modifications and changes can be made to the described apparatus and devices without departing from the spirit and scope of this invention. Accordingly, all such modifications and changes as fall within the scope of the appended claims are intended to be part of this invention.

We therefore claim:

1. A work station suitable for mounting electrical equipment comprising a hollow support beam adapted to support said equipment on at least one side of said beam during use of said work station, support legs for mounting said beam in a horizontal position above a floor;

support brackets detachably connected to at least one side of said beam and supported thereby;

horizontal work surface members mounted on said support brackets;

a vertically extending support wall detachably mounted on top of said beam and supported thereby, said support wall including rigid, vertical support columns that extend through openings formed in the top of said beam, two rigid metal panels formed by extrusion and forming two opposite sides of said support wall, and means for attaching load bearing members integrally formed on said two metal panels by the extrusion process, each column having a first side and a second side opposite the first side and said two metal panels being mounted directly to and on said first and second sides of said support columns; and connecting members detachably and fixedly connecting said support columns to the top of said beam.

2. A work station according to claim 1 wherein said connecting members are brackets affixed to the top of said beam and threaded fasteners joining said brackets to their respective columns.

3. A work station according to claim 1 wherein said two metal panels are aluminium or aluminum alloy panels.

4. A work station according to claim 1 wherein said attaching means comprises a number of horizontal, L-shaped flanges integrally connected to an outer surface of each metal panel.

5. A working station according to claim 1 wherein a cap is rigidly mounted along a top edge of said support wall and projects horizontally from opposite sides of the support wall.

6. A work station according to claim 1 wherein said metal panels are mounted on said support columns by means of clips that are each attached to their respective columns by means of two screws arranged side-by-side along a horizontal central axis of the clip.

7. A work station according to claim 6 wherein each of said clips has two horizontally extending edge flanges that are spaced from the column to which the respective clip is attached and each metal panel has a short bottom flange that is inserted behind upper ones of the edge flanges of clips arranged along a bottom edge of the respective metal panel.

8. A work station according to claim 1 wherein a junction post is attached to one end of said support beam, said post comprising a vertically extending hollow column having at least three vertical sides extending between a bottom end and a top end, at least two of said vertical sides being formed with a bottom aperture spaced a substantial distance from said bottom end and at least one upper aperture for the passage of wiring and cables positioned above said bottom aperture, wherein during use of said junction post, the adjacent one end of the beam is positioned and connected next to one of said bottom apertures so that said adjacent one end opens into the interior space of the column.

9. A work station according to claim 8 wherein a bottom plate forms said bottom end of the column and is attached to said vertical sides and adjustable levelling devices are mounted on said bottom plate, and wherein a cap is mounted on said top end of the column in order to cover same.

10. A work station according to claim 1 wherein said support brackets are extendible and each includes an elongate arm section having a rearward portion and a forward portion slidably adjustable with respect to said rearward portion and connected thereto, whereby the length of said arm section can be varied.

11. A work station according to claim 10 wherein each support bracket further includes an arm supporting section extending generally perpendicular to the length of said arm section and rigidly connected to said rearward portion.

12. A work station according to claim 10 wherein said forward portion is mounted in a telescoping manner in said rearward portion.

13. A work station according to claim 1 including an elongate raceway suitable for wire and cable mounted a distance above said beam and extending parallel to the top of said beam, and means for supporting said raceway above said beam.

14. A work station according to claim 1 including an elongate raceway suitable for wire and cable mounted a distance above said beam and extending parallel to the top of said beam, said raceway being mounted on said vertical support columns.

15. A work station suitable for mounting electrical equipment comprising:

a hollow support beam adapted to support said equipment on at least one side of said beam during use of said work station;

support legs for mounting said beam in a horizontal position above a floor;

support brackets detachably connected to at least one side of said beam and supported thereby;

horizontal work surface members mounted on said support brackets;

a vertically extending support wall detachably connected to said beam and supported thereby, said support wall including at least one rigid metal panel formed by extrusion and forming one side of said support wall, means for attaching load bearing members integrally formed on the at least one metal panel by the extrusion process, and rigid, vertical support columns that extend through openings formed in the top of said beam, each support column having a first side and a second side opposite the first side and said at least one metal panel being mounted on at least one of said first and second sides of said support columns, wherein said beam includes a horizontal bottom plate spaced a substantial distance from the top of said beam and having suitable receiving holes formed therein and wherein bottom end portions of said support columns are positioned respectively in said receiving holes so that said bottom end portions are secured from horizontal movement by said bottom plate.

16. A work station according to claim 15 wherein said receiving holes are rectangular slots each having selected horizontal dimensions, said bottom end portions of each column have combined horizontal dimensions corresponding to said selected horizontal dimensions, and said bottom end portions are force fitted into said slots, thereby preventing both vertical and horizontal movement of the bottom end of each column relative to said beam.

17. A work station according to claim 16 wherein each support column comprises two channel-shaped frame members that are connected back-to-back along their lengths and each have a central, longitudinal web section connecting two, substantially parallel legs, said bottom end portions are downward extensions of the central web sections, and bottom ends of said parallel legs rest on top of said bottom plate of the beam.

18. A work station suitable for mounting electrical equipment comprising:

a hollow support beam adapted to support said equipment on at least one side of said beam during use of said work station;

support legs for mounting said beam in a horizontal position above a floor;

support brackets detachably connected to at least one side of said beam and supported thereby;

horizontal work surface members mounted on said support brackets; and a vertically extending support wall detachably mounted on top of said beam and supported thereby, said support wall including rigid, vertical support columns that extend through openings formed in the top of said beam, each of said support columns having a first side and a second side opposite the first side, two rigid, metal support panels formed by extrusion and mounted directly to and on said first and second sides of said support columns, and means for attaching load bearing members integrally formed on the metal support panels by the extrusion process, each of said two metal support panels having a bottom edge spaced above the top of said beam so as to leave a substantially open space between the metal support panels and said beam.

19. A work station according to claim 18 wherein an elongate, open mesh wire and cable raceway is mounted on said support wall and located in said space, said raceway extending generally horizontally along said support wall in a direction parallel to said support beam.

* * * * *